United States Patent [19]

Oswald

[11] 4,311,096

[45] Jan. 19, 1982

[54] ELECTRONIC BLASTING CAP

[75] Inventor: Gerald L. Oswald, New Ringgold, Pa.

[73] Assignee: Atlas Powder Company, Dallas, Tex.

[21] Appl. No.: 146,272

[22] Filed: May 5, 1980

[51] Int. Cl.[3] ..... F42B 3/16

[52] U.S. Cl. ..... 102/202.13; 102/220

[58] Field of Search ..... 102/28 R, 28 M, 220, 102/202.9, 202.13, 215, 220

[56] References Cited

U.S. PATENT DOCUMENTS

| | | | |
|---|---|---|---|
| 3,206,612 | 9/1965 | Swanekamp et al. . | |
| 3,306,208 | 2/1967 | Bergey et al. . | |
| 3,312,869 | 4/1967 | Werner . | |
| 3,316,451 | 4/1967 | Silberman . | |
| 3,343,493 | 9/1967 | Aulds et al. . | |
| 3,424,924 | 1/1969 | Leisinger et al. . | |
| 3,610,153 | 10/1971 | Betts et al. | 102/28 R X |
| 3,618,519 | 9/1971 | Griffith . | |
| 3,618,525 | 11/1971 | Fritz | 102/28 R X |
| 3,631,802 | 1/1972 | Lawrence | 102/28 M |
| 3,653,324 | 4/1972 | Furlani et al. | 102/220 X |
| 3,762,331 | 10/1973 | Vlahos | 102/28 R X |
| 3,787,740 | 1/1974 | Salton et al. | 102/220 X |
| 3,788,228 | 1/1974 | Wilson | 102/220 X |
| 3,834,310 | 9/1974 | Ueda et al. | 102/220 X |
| 3,878,786 | 4/1975 | Ridgeway | 102/28 R X |
| 4,088,075 | 5/1978 | Hayman | 102/220 |
| 4,239,004 | 12/1980 | Day et al. | 102/28 R |

*Primary Examiner*—Peter A. Nelson

*Attorney, Agent, or Firm*—Richards, Harris & Medlock

[57] ABSTRACT

An electronic blasting cap (10) includes a housing (12) which is closed at one end and has adjacent thereto it a base charge (14), a primer charge (16) and an ignition charge (18). The charges (14, 16, 18) are positioned within housing (12) by a metal capsule (20). An electric match assembly (26) is positioned within an insulated spacer (24) within housing (12). An electronic module (32) comprising an electronic delay circuit (90) fixed within a potting compound is positioned within housing (12). A sealing plug (38) closes housing (12) by means of crimps (40, 42). An input signal is received over leg wires (34, 36) for storing an electric charge within circuit 90 which fires the electric match assembly 26 following a preset time delay.

46 Claims, 6 Drawing Figures

ELECTRONIC BLASTING CAP

TECHNICAL FIELD

The present invention pertains in general to blasting caps and more particularly to a blasting cap which includes an electronic circuit for firing the blasting cap following a preset delay.

BACKGROUND ART

In most blasting operations, efficient use of explosive energy includes obtaining the desired breakage and movement of ore and rock. It is also becoming increasingly important to minimize the effects of blasting on nearby structures by maintaining close control over ground vibrations produced by the blast. In a multi-hole blasting pattern, it is usually desirable not to have all of the explosives detonate at one time, but to separate the detonation of each hole by at least eight milliseconds in time to control ground vibrations. The separation of the total weight of explosives used in a blast into smaller charges detonated individually in time sequence is achieved by means of delay blasting. Delay blasting normally involves the use of electric or nonelectric delay blasting caps, detonating cord delay connectors or blasting machines of the sequential type.

All presently manufactured electric and nonelectric delay blasting caps have internal delay elements which are based upon the timed burning of pyrotechnical mixtures compressed into metal tubes. The delay timing is achieved by the ignition and burning of the pyrotechnic mixture.

The problem with pyrotechnic delay blasting caps is that, even under the most careful manufacturing conditions, the delay timing of any given delay period is subject to inherent time scatter due to the nature of the burning process. Therefore, the exact detonation time of the blasting cap cannot be controlled with high precision. Because of time scatter, it is possible for pyrotechnic delay blasting caps of two adjoining delay periods to detonate so close together in time that an undesirable level of ground vibration is produced since more than the optimum weight of explosives is detonated at the same time.

The sequential type blasting machines provide controlled timing electric pulses to electric blasting caps. These timing pulses are formed by electronic means and are precise. However, during blasting, circuit wires between the blasting machine and the electric blasting caps must be maintained intact until the blasting caps receive the firing pulses from the machine. Therefore, it has been found that sequential switches must be used in conjunction with pyrotechnic delay electric blasting caps placed in the boreholes to minimize the premature breaking or shorting of circuit wires. Problems with control of vibrations therefore are the same as with the aforementioned use of pyrotechnic delay electric blasting caps.

Unless the sequential blast is designed to have all caps ignited before the first hole detonates, the possibility for broken or shorted circuit wires is increased. Many sequential blasting patterns do not permit all caps to be ignited before hole detonation begins.

In many cases, sequential blasting machine patterns are designed so that there are only eight milliseconds between detonations. It can be seen that the normal scatter in pyrotechnical delays will result in detonations at less than eight millisecond intervals and will increase the probability of out of sequence detonations. When this occurs, ground vibrations may be increased and rock fragmentation may be poor.

Because pyrotechnic delay blasting caps must be used with sequential blasting machines, problems with vibration control and rock fragmentations are the same as with the aforementioned use of delay electric blasting caps.

As explained previously, standard delay blasting involves detonating individual explosive columns at predetermined time intervals. During this process, boreholes that detonate at later delay intervals are subjected to shock and gas pressures generated from the detonation of explosives in adjoining boreholes. Blasting caps are required to withstand these pressures and must function properly at the desired delay interval.

The component parts of an electric blasting system include the blasting machine, firing line, connecting wires, and electric blasting caps.

Electric blasting caps are commonly fired from capacitor discharge type blasting machines. These power sources utilize an energy storage capacitor that is charged to a high voltage such as 450 VDC. Upon activation of a firing switch, the energy is released to the blasting caps through a firing line and connecting wires. Low resistance, heavy gauge copper firing lines and connecting wires are commonly used to minimize energy losses.

Blasting circuits are laid out in series, parallel, or parallel series combinations to permit efficient use of available electrical energy. To assure that the energy is distributed properly, blasting personnel are required to optimize the blasting circuit design by performing energy calculations, which often become difficult and complex. The resistance balancing of parallel branches is also necessary for optimum energy distribution. In the event that the available energy is not distributed properly, and a blasting cap fails to fire because of insufficient current, undetonated explosives will remain in the muckpile resulting in a very hazardous condition.

Many mining and construction companies have difficulty in hiring qualified blasters, and in many cases the turnover of personnel is very high. The frequent training of new blasters, although very important, becomes very costly and time consuming. Therefore, simplification of electric blasting would be advantageous from both a training and the aforementioned safety standpoints.

The high voltage from a standard blasting machine poses either a possible shock hazard condition to blasting personnel or a problem of current leakage from damaged insulation or bare wire connections. A lower voltage electric blasting system would not present a shock hazard, and would be far less susceptible to current leakage, thus, reducing the possibility of misfires.

Electric blasting caps can be fired from a 1½ volt flashlight cell. It would be desirable to increase this voltage requirement to reduce the susceptibility of the cap to be prematurely initiated by extraneous electricity.

In summary, the need for precise delay timing can be clearly justified by improving rock fragmentation and reducing undesirable levels of ground vibration. Also, improving the safety of electric blasting systems is a continuing goal for companies associated with explosives. Reliability, susceptibility to extraneous electricity and simplification of firing systems are all vital areas for safety improvement considerations.

DISCLOSURE OF THE INVENTION

The present invention is an electronic blasting cap which comprises an elongated housing closed at one end thereof, an explosive charge located within said housing adjacent the closed end thereof, an electric ignition assembly such as an electric match assembly mounted within the housing and having an ignition element for igniting the explosive charge. An electronic module is located within the housing and is connected to receive an externally supplied signal from a firing line for storing electrical energy in the electronic module. The electric match assembly is connected to the electronic module for receiving at least a part of the stored electrical energy for igniting the ignition element which in turn ignites the explosive charge.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1:
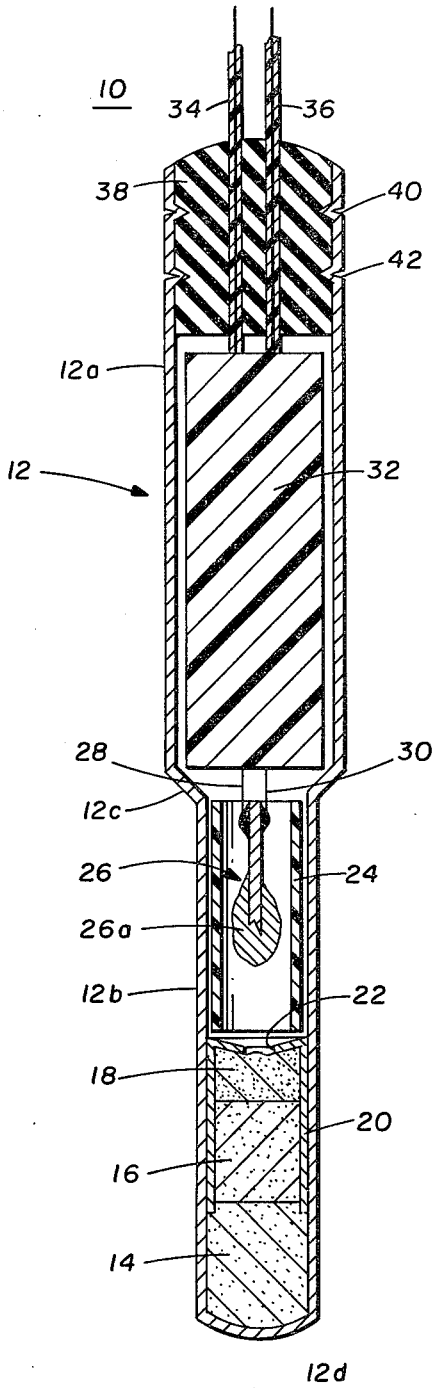
FIG. 1 is a sectioned, elevation view of an electronic blasting cap.

In the following descriptive material, like reference numerals refer to like components in the various views.

Referring to FIG. 1, there is illustrated a preferred embodiment of an electronic blasting cap in accordance with the present invention. An electronic blasting cap 10 has a cylindrical, elongate housing 12 which has an upper segment **12*a* with a greater diameter and the lower segment 12*b* with a lesser diameter. Housing 12 has an inwardly tapering segment 12*c* which blends upper segment 12*a* into lower segment 12*b*. The housing 12** is preferably made of a metal such as copper, copper alloy, aluminum, aluminum alloy or steel.

The lower end of housing 12 has a closed end **12*d* adjacent to which is located a base charge 14 which comprises an explosive such as PETN, tetryl, RDX or mercury fulminate. Immediately above the base charge 14 within housing 12 there is located a primer charge 16 which is an explosive such as Diazo, Lead Azide, HNM, Diazo/HNM or Lead Styphnate/Lead Azide. Adjacent immediately above the primer charge 16 there is an ignition charge 18** which is, for example, an explosive such as Diazo, Lead Styphnate, Diazo/HNM or Lead Styphnate/Lead Azide.

The charges 14, 16 and 18 may be held in place within housing 12 by a metal capsule 20 which fully encloses charges 16 and 18 and partially encloses charge 14. Capsule 20 is open at the end facing base charge 14 and is partially closed at the opposite end. A hole 22 at the upper end of capsule 20 leaves a portion of the ignition charge 18 exposed.

A cylindrical, insulating spacer 24 is located within segment **12*b* of housing 12 immediately above the metal capsule 20. Spacer 24** is open at both ends.

An electric ignition assembly such as electric match assembly 26 is positioned within spacer 24 and includes an ignition element **26*a*. The electric match assembly 26 is fired by receiving an electrical charge through lines 28 and 30**.

An electronic control module 32 is positioned in segment **12*a* of housing 12 immediately above the tapered segment 12*c*. Module 32 includes an electronic circuit, described below, which is potted in material such as epoxy potting compound, a low durometer hardness material, such as hardman EP2408TS, a combination of epoxy and elastomer or various synthetic rubber materials which provide sufficient shock protection. The electronic circuit in module 32 is connected to the electric ignition assembly 26 through lines 28 and 30. The charging and firing signal for the electronic circuit is received through leg wires 34 and 36 which extend from module 32 to exterior of housing 12**.

The upper end of housing 12 is sealed with a plug 38 which is a rubber or plastic material that provides a water-proof seal for housing 12. Plug 38 is secured within housing segment 12 by crimps 40 and 42.

In operation, the electronic blasting cap 10 receives a charging signal through leg wires 34 and 36 which store an electrical charge within module 32. Depending upon the circuit used within module 32, a timing signal is initiated when the incoming signal makes a sudden amplitude transition. Following this amplitude transition a preset time period elapses before a portion of the stored electric charge is transferred through lines 28 and 30 to cause ignition of the electric match assembly 26.

Firing element **26*a* of the electric match assembly 26 is exposed through hole 22 to the ignition charge 18. After element 26*a* has fired, the energy produced by this element will cause the ignition charge 18 to ignite. The firing of charge 18 in turn causes the initiation of charge 16 which further causes initiation of the base charge 14**.

Figure 2:
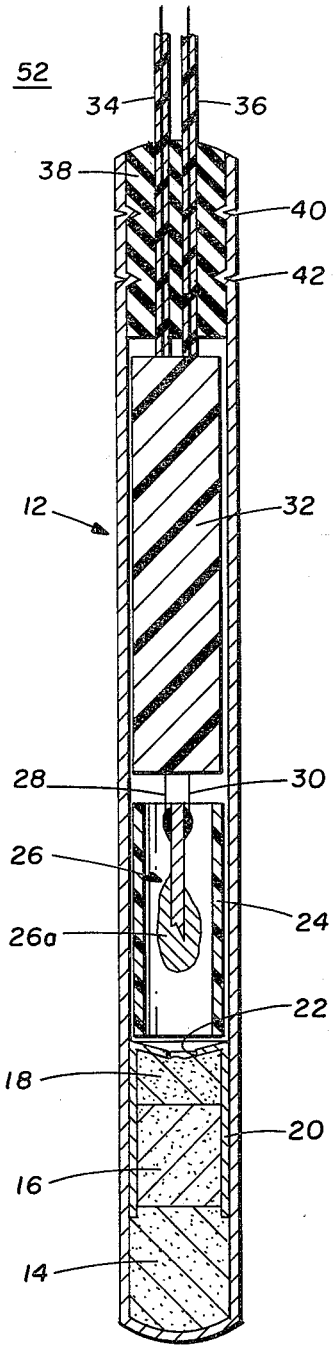
FIG. 2 is a sectioned, elevation view of an alternative embodiment of an electronic blasting cap.

Referring to FIG. 2, there is a shown a modified version of the blasting cap illustrated in FIG. 1. Blasting cap 52 is similar in all respects to blasting cap 10 with the exception that housing 12 is a cylinder having a uniform diameter along the length thereof.

Figure 3:
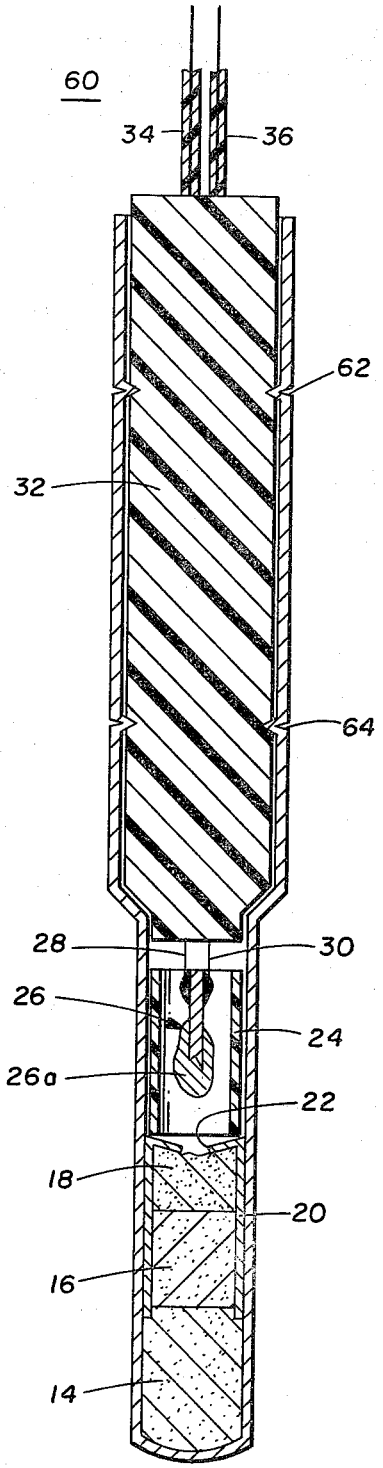
FIG. 3 is a sectioned, elevation view of an alternative embodiment of an electronic blasting cap.

A further embodiment of the blasting cap of the present invention is illustrated in FIG. 3. Blasting cap 60 is essentially the same as blasting cap 10 illustrated in FIG. 1 with the exception that sealing plug 38 has been deleted. The module 32 is lengthened and extended to the upper end of housing 12. Housing 12 is sealed to module 32 by crimps 62 and 64. Blasting cap 60 functions in the same manner as that described for blasting cap 10 in FIG. 1.

Figure 4:
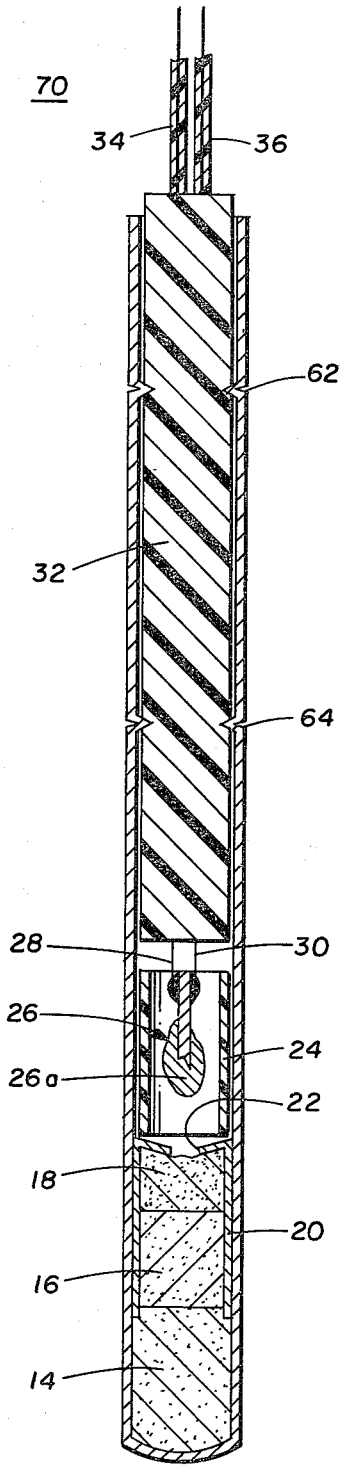
FIG. 4 is a sectioned, elevation view of an alternative embodiment of an electronic blasting cap.

A further embodiment of the present invention is a blasting cap 70 illustrated in FIG. 4. Blasting cap 70 is similar to blasting cap 60 illustrated in FIG. 3 with the exception that the housing 12 has a uniform diameter along the length thereof. Otherwise, the structure and function of the blasting cap 70 is similar to that of blasting cap 60.

Figure 5:
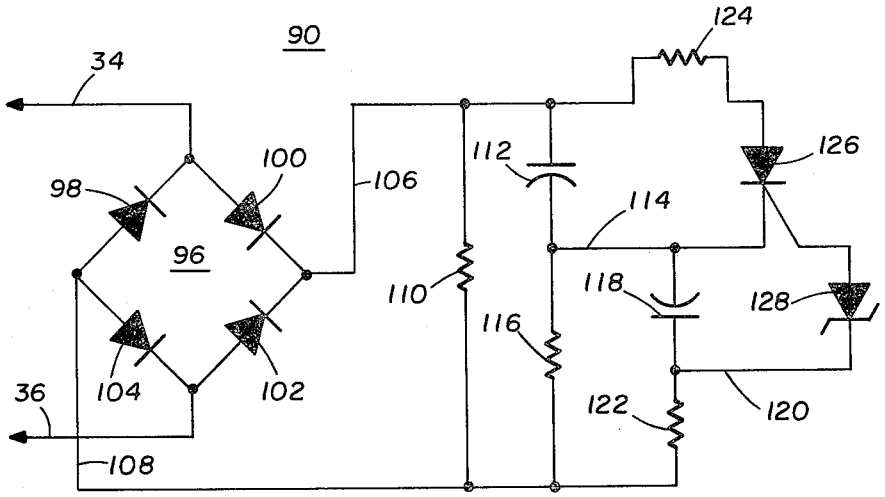
FIG. 5 is a schematic illustration of an electronic ignition circuit for use with the blasting cap illustrated in FIGS. 1-4.
Figure 6:
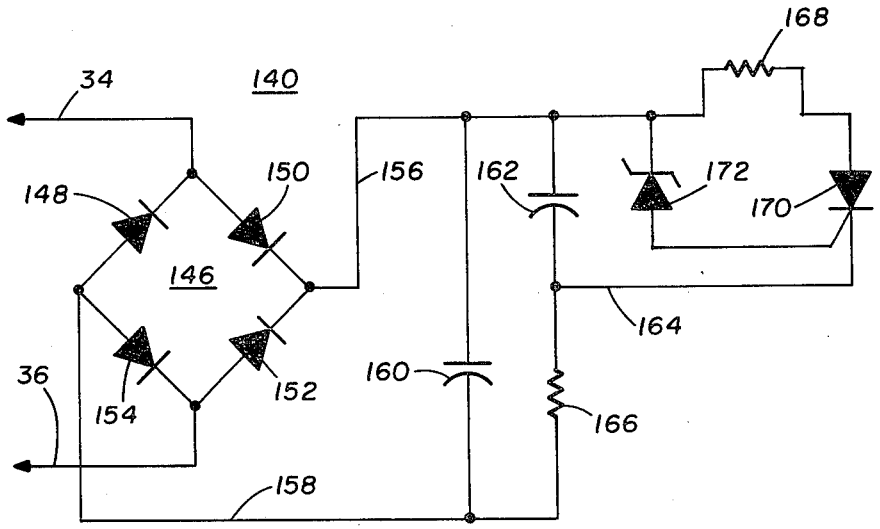
FIG. 6 is a schematic illustration of an alternative electronic firing circuit for use with the blasting caps illustrated in FIGS. 1-4.

The electronic circuits which are utilized within module 32 are illustrated in FIGS. 5 and 6.

Referring to FIG. 5, an electronic delay blasting circuit 90 is connected to receive an input charging signal through leg wires 34 and 36. The input charging signal is preferably a DC signal at 12, 24 or 48 volts. The input charging signal can, however, be AC. The leg wires 34 and 36 are connected to the input terminals of a full-wave rectifier 96. Rectifier 96 is a diode bridge comprising diodes 98, 100, 102 and 104. The output terminals of rectifier 96 are connected to lines 106 and 108.

A resistor 110 has a first terminal thereof connected to line 106 and a second terminal thereof connected to line 108.

A capacitor 112 is connected between line 106 and a node 114. A resistor 116 is connected between node 114 and line 108. Resistor 116 is connected in series with capacitor 112 between lines 106 and 108.

A capacitor 118 is connected between node 114 and a second node 120. A resistor 122 is connected between node 120 and line 108. Resistor 122 is connected in series with capacitor 118 between node 114 and line 108.

A resistive ignition element 124, such as a resistance wire, has a first terminal thereof connected to line 106 and a second terminal thereof connected to the anode terminal of a silicon controlled rectifier (SCR) 126. The cathode terminal of SCR 126 is connected to node 114. The gate terminal of SCR 126 is connected to the anode terminal of a zener diode 128. The cathode terminal of zener diode 128 is connected to node 120.

The operation of electronic delay blasting circuit 90 is now described in reference to FIG. 5. Circuit 90 is fabricated to be an integral part of a blasting cap (shown in FIGS. 1–4) which serves to ignite a primary charge. As noted above, heavy gauge wire and a high energy power source have heretofore been required for the activation of a plurality of electric blasting caps. The circuit of the present invention, however, permits the firing of a plurality of blasting caps and requires only a small gauge firing line and a low energy power source.

The input signal, either AC or DC to circuit 90 is provided through leg wires 34 and 36 to the full-wave rectifier 96. The output of rectifier 96 is a DC signal between lines 106 and 108 in which line 106 is the more positive relative to line 108.

The DC signal produced by rectifier 96 is applied directly to resistor 110 and to capacitor 112 through resistor 116. Capacitor 112 is charged by the DC signal and the rate of charge is dependent upon its capacitance, the resistance of resistor 116, the impedance of diodes 98–104 and the internal resistance of the energy source (not shown) which supplies the input signal to the leg wires 34 and 36. After a period of time, capacitor 112 will become charged to the peak level of the DC voltage produced by rectifier 96.

During the charging of capacitor 112, a current will flow through resistor 116 which will produce a voltage across the series combination of resistor 122 and capacitor 118. This will produce a temporary charge on capacitor 118 which will tend to apply a negative bias to the gate terminal of SCR 126. Since SCR 126 is in the off state at this time the voltage across capacitor 118 has no effect on SCR 126 during the charging of capacitor 112. After capacitor 112 has reached its full charge, capacitor 118 will discharge through resistors 116 and 122.

After capacitor 112 has reached a full charge provided by the DC signal produced by rectifier 96, circuit 90 will be in the quiescent state. Current will continue to flow through resistor 110 but the current flow through the remainder of the circuit will be minute. When the capacitor 112 is charged to approximately the peak value of the input signal provided on lines 34 and 36, circuit 90 is armed and in the ready to fire condition.

Upon removal of the input signal from lines 34 and 36 which constitutes a sudden transition, reducing the amplitude of the input signal, the delay elements of circuit 90 are activated. Storage capacitor 112 now becomes the source of energy for circuit 90. Current flow is established through resistors 110 and 116 which produces a voltage differential across resistor 116 that in turn produces a current flow through the series combination of resistor 122 and capacitor 118. For a period of time the voltage across capacitor 118 will increase continuously until the voltage on the capacitor is equal to the threshold, reference, voltage of zener diode 128. When the voltage of capacitor 118 reaches this threshold voltage, zener diode 128 will be reversed biased and a positive voltage will be applied to the gate terminal of SCR 126. The positive potential on the gate terminal causes SCR 126 to become conductive which in turn connects the resistive ignition element 124 directly across the terminals of capacitor 112. A substantial portion of the remaining charge on capacitor 112 is applied to element 124 and is sufficient to cause the element to ignite. This in turn causes detonation of the blasting cap containing circuit 90.

The time delay between the removal of the input signal and the firing of element 124 is determined by resistors 110, 116 and 122 together with the capacitance of capacitors 112 and 118. The most direct method, however, for setting the time delay of circuit 90 is to adjust the values of resistor 122 and capacitor 118.

An important aspect of the electronic delay blasting cap is that once the unit is armed by an input signal, the circuit will function normally even if the external firing line or leg wires become broken or short circuited during the blast. The rectifier 96 is used to isolate the armed circuit from the external circuit to prevent the external circuit from affecting the timing operation and to prevent the stored energy from bleeding back into the input wires. The rectifier 96 also permits firing line connections to be made without regard to polarity. Also, the reliability of the blasting operation is substantially increased by storing electrical energy in a capacitor which is a component part of each electronic delay blasting cap. This permits all of the caps in a blasting pattern to be armed and self-operating before the first hole detonates. Therefore, the problems associated with breaking or shorting of circuit wires, due to burden or surface movement in a blast, are eliminated.

In addition, the delay time of an electronic delay blasting cap as described herein is extremely accurate and precise when compared to conventional delay blasting caps using pyrotechnic mixtures for delay timing.

A design example for the circuit shown in FIG. 5 is provided with the values shown in Table 1.

TABLE I

| | | |
|---|---|---|
| Input Signal | = | 24 Volts DC |
| Resistor 110 | = | 2K Ohms, ⅛Watt |
| Resistor 116 | = | 10K Ohms, ⅛Watt |
| Resistor 122 | = | 100K Ohms, ⅛Watt |
| Capacitor 112 | = | 100 Microfarads, 25 VDC |
| Capacitor 118 | = | 1 Microfarad, 12 VDC |
| Zener Diode 128 | = | 12 Volts, ½Watt - Sylvania |

TABLE I-continued

| | | |
|---|---|---|
| | | ECG-5021 |
| SCR 126 | = | 0.8 Amps - Sylvania ECG-5400 |
| Ignition Element 122 | = | Instantaneous Electric Blasting Cap |
| Delay Period | = | 141 Milliseconds (± 1 Milliseconds) |

A plurality of electronic blasting caps utilizing the circuit shown in FIG. 1 have been tested when connected in straight parallel. The blasting caps were activated successfully with approximately the same delay time.

A further embodiment of the present invention is illustrated in FIG. 6. Electronic delay blasting circuit 140, which is fabricated to be an integral part of a blasting cap, receives an input signal over leg wires 34 and 36 which are connected to the input terminals of a full-wave rectifier 146. A plurality of diodes 148, 150, 152 and 154 are connected in a bridge arrangement to form rectifier 146. The output terminals of rectifier 146 are connected to lines 34 and 36. Rectifier 146 produces a DC signal output on lines 156 and 158 with line 156 positive relative to line 158.

An energy storage capacitor 160 has a first terminal thereof connected to line 156 and a second terminal thereof connected to line 158.

A capacitor 162 has a first terminal connected to line 156 and a second terminal connected to a node 164. A resistor 166 is connected between node 164 and line 158.

A resistive ignition element 168 has a first terminal connected to line 156 and a second terminal connected to the anode terminal of an SCR 170. The cathode terminal of SCR 170 is connected to node 164.

A zener diode 172 has the anode terminal thereof connected to the gate terminal of SCR 170 and the cathode terminal thereof connected to line 156.

The electronic firing circuit 140 functions in a different manner from that of circuit 90 shown in FIG. 5. The time delay period of circuit 140 begins upon the application of the input signal. When the input signal transitions from a zero level to its full potential a current pulse is applied through leg wires 34 and 36 to the rectifier 146. This current pulse produces a DC signal at the output of rectifier 146 between lines 156 and 158. The DC signal resulting from the current pulse starts to immediately charge capacitor 160 while charging capacitor 162 through resistor 166. After the initial transition of the input pulse the voltage on capacitor 162 will continuously increase until it reaches the threshold voltage of zener diode 172. When the threshold is reached the zener diode 172 will become conductive and the gate terminal of SCR 170 will have a positive voltage applied thereto. A positive voltage on the gate terminal of SCR 170 causes the SCR to become conductive and connect the ignition element 168 directly between line 156 and node 164. The energy stored on capacitors 160 and 162 will then be directed through the ignition element 168 to cause ignition thereof.

The time delay of circuit 140 is controlled by the charging of capacitor 162 and this is primarily determined by the resistance value of resistor 166.

The use of circuit 140 in place of circuit 90 provides an advantage in the case where an open or short should occur in the firing circuit before the storage capacitor in circuit 90 is fully charged. When this occurs the time delay for the blast does not occur on schedule. But with the circuit 140 the time period is initiated at the start of the input signal. The circuit 140, however, requires the use of heavy gauge, low resistance firing line and a high energy firing source in order to fire a substantial number of caps in a single blast.

A further advantage of circuit 140 is that it has fewer components than circuit 90. By having fewer components circuit 140 is less expensive and is also more reliable since there are fewer circuit elements subject to failure.

The electronic blasting caps of the present invention offer numerous advantages including:

(a) the accuracy and precision of the timing of the electronic delay blasting cap is far superior to presently available pyrotechnic delays;

(b) the use of electronic delay blasting caps enables much better control over ground vibrations produced in multiple charge blasting operations by accurately controlling the time intervals between detonations;

(c) the use of electronic delay blasting caps gives blasting operators greater flexibility by permitting the use of more individual charges. This can be accomplished because the detonation can be controlled with greater precision and accuracy, thereby presenting the possibility of reducing the time intervals between detonations;

(d) the use of electronic delay blasting caps improves blasting results by eliminating out-of-sequence detonations;

(e) the combination of the electronic delay blasting cap and the sequential switch gives a more complete blast initiation system to delay times controlled completely by electronic means rather than by a combination of electronic (sequential switch) and pyrotechnic means.

The electronic delay blasting circuits of the present invention provide more reliability in blasting operations for the following reasons:

(a) all of the caps are armed prior to the detonation of any blast hole;

(b) the caps can be activated from a low voltage power source, thereby eliminating the shock hazard to blasting personnel and reducing the possibility of current leakage;

(c) all of the caps are connected in parallel which eliminates the need for energy calculations, thus, providing a blasting system that is more simple than conventional electric blasting systems.

The electronic delay blasting circuits of the present invention also provide a greater safety margin over conventional electric blasting caps for the following reasons:

(a) the blasting circuits of the present invention require higher voltage levels for initiation;

(b) the resistance to static electricity is improved with the control circuit components, (c) the need for energy calculations is eliminated thus reducing the possibility of misfires.

A further advantage of the circuits of the present invention is that the time delay for the electronic delay blasting cap can be measured accurately during production to allow stamping of the actual delay time on the cap prior to field use. This assures that a correct time delay cap is used in a given operation.

Although several embodiments of the invention have been illustrated in the accompanying drawings and described in the foregoing detailed description, it will be understood that the invention is not limited to the embodiments disclosed, but is capable of numerous rearrangements, modifications and substitutions without departing from the scope of the invention.

I claim:

1. An electronic blasting cap, comprising:

an elongate housing closed at one end thereof;

an explosive charge located within said housing; an electric ignition assembly mounted within said housing and having an ignition element for igniting said explosive charge; and an electronic module located within said housing and connected to receive an externally supplied signal through a firing line for storing electrical energy in said electronic module, said electric ignition assembly connected to said electronic module for receiving at least a part of said stored electrical energy for igniting said ignition element which in turn ignites said explosive charge.

2. The electronic blasting cap recited in claim 1 wherein said electronic module includes means for igniting said electric ignition assembly ignition element after a preset time delay following a transition of said externally supplied signal.

3. The electronic blasting cap recited in claim 1 wherein said explosive charge comprises:

a base charge contiguous the closed end of said housing;

a primer charge adjacent said base charge; and an ignition charge adjacent said primer charge and exposed to said ignition element of said electric ignition assembly.

4. The electronic blasting cap recited in claim 3 including a cylindrical metal capsule located within said housing and having a first open end and a second partially open end, said capsule containing said ignition charge exposed to said ignition element through said second partially open end and containing said primer charge between said ignition charge and said base charge.

5. The electronic blasting cap recited in claim 1 including a cylindrical, insulating spacer within said housing and enclosing said electric ignition assembly.

6. The electronic blasting cap recited in claim 1 including means for closing said housing.

7. The electronic blasting cap recited in claim 6 wherein said means for closing comprises a plug inserted into the open end of said housing and connected thereto.

8. The electronic blasting cap recited in claim 6 wherein said means for closing comprises a potted extension of said electronic module filling the open end of said housing and connected thereto.

9. The electronic blasting cap recited in claim 1 wherein said housing is a cylinder having essentially a constant diameter along the length thereof.

10. The electronic blasting cap recited in claim 1 wherein said housing is a cylinder having a greater diameter enclosing said electronic module and a lesser diameter enclosing said electric ignition assembly and said explosive charges.

11. The electronic blasting cap as recited in claim 1 wherein said electronic module comprises:

means for full-wave rectifying said externally supplied signal to produce a DC signal;

means connected to receive said DC signal and store an electrical charge;

means responsive to a transition of said externally supplied signal for producing a timing signal which has a changing voltage;

means for detecting when said timing signal is equal to a reference voltage; and means for transferring at least a part of said electrical charge to said ignition element when said means for detecting detects that said timing signal is equal to said reference signal.

12. The electronic blasting cap recited in claim 11 wherein said means for full-wave rectifying is a four diode bridge.

13. The electronic blasting cap recited in claim 11 wherein said means connected to receive said DC signal is a capacitor coupled to the output terminals of said means for rectifying.

14. The electronic blasting cap recited in claim 11 wherein said means for producing a timing signal is a series combination of a resistor and a capacitor.

15. The electronic blasting cap recited in claim 11 wherein said means for detecting is a zener diode connected to monitor said timing signal.

16. the electronic blasting cap recited in claim 11 wherein said means for transferring is a silicon controlled rectifier connected to said ignition element and activated by said means for detecting.

17. An electronic blasting cap comprising:

an elongate housing closed at one end thereof;

an explosive charge located within said housing;

an electric ignition assembly mounted within said housing and having an ignition element for igniting said explosive charge; and an electronic module located within said housing and connected to receive an externally supplied signal through a firing line for storing electrical energy in said electronic module, said electric ignition assembly connected to said electronic module for receiving at least a part of said stored electrical energy for igniting said ignition element which in turn ignites said explosive charge, said electronic module comprising:

(i) a full-wave rectifier having input terminals for receiving said externally supplied signal to produce therefrom a DC output signal which has a positive polarity at a first output terminal relative to a second output terminal;

(ii) a first resistor having the terminals thereof connected respectively to said first and second input terminals;

(iii) a first capacitor having a first terminal thereof connected to said first output terminal and a second terminal thereof connected to a first node;

(iv) a second resistor having a first terminal thereof connected to said first node and a second terminal thereof connected to said second output terminal;

(v) a second capacitor having a first terminal thereof connected to said first node and a second terminal thereof connected to a second node;

(vi) a third resistor having a first terminal thereof connected to said second node and a second terminal thereof connected to said second output terminal;

(vii) a silicon controlled rectifier having anode, cathode and gate terminals, the cathode terminal thereof connected to said first node;

(viii) a zener diode having the anode terminal thereof connected to the gate terminal of said silicon controlled rectifier and the cathode terminal thereof connected to said second node; and (ix) said ignition element having a first terminal thereof connected to said first output terminal and a second terminal thereof connected to the anode terminal of said silicon controlled rectifier.

18. The electronic blasting cap recited in claim 17 wherein said full-wave rectifier is a four diode bridge.

19. An electronic blasting cap comprising:

an elongate housing closed at one end thereof;

an explosive charge located within said housing;

an electric ignition assembly mounted within said housing and having an ignition element for igniting said explosive charge; and an electronic module located within said housing and connected to receive an externally supplied signal through a firing line for storing electrical energy in said electronic module, said electric ignition assembly connected to said electronic module for receiving at least a part of said stored electrical energy for igniting said ignition element which in turn ignites said explosive charge, said electronic module comprising:

(i) a full-wave rectifier having input terminals for receiving said externally supplied signal to produce therefrom a DC output signal which has a positive polarity at a first output terminal relative to a second output terminal;

(ii) a first capacitor having the terminals thereof connected respectively to said first and second output terminals;

(iii) a second capacitor having a first terminal thereof connected to said firt output terminal and a second terminal thereof connected to a first node;

(iv) a first resistor having a first terminal thereof connected to said first node and a second terminal thereof connected to said second output terminal;

(v) a silicon controlled rectifier having anode, cathode and gate terminals, the cathode terminal thereof connected to said first node;

(vi) a zener diode having the anode terminal thereof connected to the gate terminal of said silicon controlled rectifier and the cathode terminal thereof connected to said first output terminal; and (vii) said ignition element having a first terminal thereof connected to said first output terminal and a second terminal thereof connected to the anode terminal of said silicon controlled rectifier.

20. The electronic blasting cap recited in claim 19 wherein said full-wave rectifier is a four diode bridge.

21. An electronic blasting cap, comprising:

a cylindrical housing closed at one end and having a lesser diameter along a first section thereof and a greater diameter along a second section thereof;

a base charge within the first section of said housing contiguous the closed end thereof;

a metal cylinder disposed within the second section of said housing, said cylinder open at one end and partially closed at the opposite end, the open end of said cylinder adjacent said base charge;

a primer charge located within said cylinder and contiguous said base charge;

an ignition charge located within said cylinder adjacent the partially closed end thereof and contiguous said primer charge;

an electrically insulating cylinder located within the first section of said housing adjacent the partially closed end of said cylinder;

an electric ignition assembly located within said insulating cylinder;

a potted, electronic control module located within the second section of said housing and having control wires connected to said electric ignition assembly for ignition thereof, said electronic module having insulated wires extending from said module to exterior said housing; and means for closing the open end of said housing.

22. The electronic blasting cap recited in claim 21 wherein said means for closing comprises a plug inserted into the open end of said housing and connected thereto.

23. The electronic blasting cap recited in claim 21 wherein said means for closing comprises an extension of said potted control module filling the open end of said housing and connected thereto.

24. The electronic blasting cap recited in claim 21 wherein said electronic module comprises:

means for full-wave rectifying an input signal to produce a DC signal;

means connected to receive said DC signal and store an electrical charge;

means responsive to a transition of said input signal for producing a timing signal which has a continuously changing voltage;

means for detecting when said timing signal is equal to a reference voltage; and means for transferring at least a part of said electrical charge to said resistive element when said means for detecting detects that said timing signal is equal to said reference signal.

25. The circuit recited in claim 24 wherein said means for full-wave rectifying is a four diode bridge.

26. The circuit recited in claim 24 wherein said means connected to receive said DC signal is a capacitor coupled to the output terminals of said means for rectifying.

27. The circuit recited in claim 24 wherein said means for producing a timing signal is a series combination of a resistor and a capacitor.

28. The circuit recited in claim 24 wherein said means for detecting is a zener diode connected to monitor said timing signal.

29. The circuit recited in claim 24 wherein said means for transferring is a silicon controlled rectifier connected to said resistive element and activated by said means for detecting.

30. An electronic blasting cap comprising:

a cylindrical housing closed at one end and having a lesser diameter along a first section thereof and a greater diameter along a second section thereof;

a base charge within the first section of said housing contiguous the closed end thereof;

a metal cylinder disposed within the second section of said housing, said cylinder open at one end and partially closed at the opposite end, the open end of said cylinder adjacent said base charge;

a primer charge located within said cylinder and contiguous said base charge;

an ignition charge located within said cylinder adjacent the partially closed end thereof and contiguous said primer charge;

an electrically insulating cylinder located within the first section of said housing adjacent the partially closed end of said cylinder;

a potted, electronic control module located within the second section of said housing and having control wires connected to said electric ignition assembly for ignition thereof, said electronic module having insulated wires extending from said module to exterior said housing; said electronic control module comprising:

(i) a full-wave rectifier having input terminals for receiving an input signal to produce therefrom a DC output signal which has a positive polarity at a first output terminal relative to a second output terminal;

(ii) a first resistor having the terminals thereof connected respectively to said first and second output terminals;

(iii) a first capacitor having a first terminal thereof connected to said first output terminal and a second terminal connected to a first node;

(iv) a second resistor having a first terminal thereof connected to said first node and a second terminal thereof connected to said second output terminal;

(v) a second capacitor having a first terminal thereof connected to said first node and second terminal thereof connected to a second node;

(vi) a third resistor having a first terminal thereof connected to said second node and a second terminal thereof connected to said second output terminal;

(vii) a silicon controlled rectifier having anode, cathode and gate terminals, the cathode terminal thereof connected to said first node;

(viii) a zener diode having the anode terminal thereof connected to the gate terminal of said silicon controled recitifer and the cathode terminal thereof connected to said second node; and (ix) a resistive firing element having a first terminal thereof connected to said first output terminal and a second terminal thereof connected to the anode terminal of said silicon controlled rectifier, and means for closing the open end of said housing.

31. The circuit recited in claim 30 wherein said full-wave rectifier is a four diode bridge.

32. The electronic blasting cap recited in claim 21 wherein said electronic module comprises:

a cylindrical housing closed at one end and having a lesser diameter along a first section thereof and a greater diameter along a second section thereof;

a base charge within the first section of said housing contiguous the closed end thereof;

a metal cylinder disposed within the second section of said housing, said cylinder open at one end and partially closed at the opposite end, the open end of said cylinder adjacent said base charge;

a primer charge located within said cylinder and contiguous said base charge;

an ignition charge located within said cylinder adjacent the partially closed end thereof and contiguous said primer charge;

an electrically insulating cylinder located within the first section of said housing adjacent the partially closed end of said cylinder;

an electric ignition assembly located within said insulating cylinder;

a potted, electronic control module located within the second section of said housing and having control wires connected to said electric ignition assembly for ignition thereof, said electronic module having insulated wires extending from said module to exterior said housing;

said electronic control module comprising:

(i) a full-wave rectifier having input terminals for receiving an input signal to produce therefrom a DC output signal which has a positive polarity at a first output terminal relative to a second output terminal;

(ii) a first capacitor having the terminals thereof connected respectively to said first and second output terminals;

(iii) a second capacitor having a first terminal thereof connected to said first output terminal and a second terminal thereof connected to a first node;

(iv) a first resistor having a first terminal thereof connected to said first node and a second terminal thereof connected to said second output terminal;

(v) a silicon controlled rectifier having anode, cathode and gate terminals, the cathode terminal thereof connected to said first node;

(vi) a zener diode having the anode terminal thereof connected to the gate terminal of said silicon controlled rectifier and the cathode terminal thereof connected to said first output terminal; and (vii) a resistive firing element having a first terminal thereof connected to said first output terminal and a second terminal thereof connected to the anode terminal of said silicon controlled rectifier, and means for closing the open end of said housing.

33. The circuit recited in claim 32 wherein said full-wave rectifier is a four diode bridge.

34. An electronic blasting cap, comprising:

a cylindrical housing closed at one end;

a base charge within said housing contiguous the closed end thereof;

a metal cylinder disposed within said housing, said cylinder open at one end and partially closed at the opposite end, the open end of said cylinder adjacent said base charge;

a primer charge located within said cylinder and contiguous said base charge;

an ignition charge located within said cylinder adjacent the partially closed end thereof and contiguous said primer charge;

an electrically insulating cylinder located within said housing adjacent the partially closed end of said cylinder;

an electric ignition assembly located within said insulating cylinder;

a potted, electronic control module located within said housing for storing an electrical charge and having control wires connected to said electric ignition assembly for transmitting at least a part of said stored electrical charge for ignition of said electric ignition assembly, said electronic module having insulated wires extending from said module to exterior said housing for receiving said electrical charge; and means for closing the open end of said housing.

35. The electronic blasting cap recited in claim 34 wherein said means for closing comprises a plug inserted into the open end of said housing and connected thereto.

36. The electronic blasting cap recited in claim 34 wherein said means for closing comprises an extension of said potted control module filling the open end of said housing and connected thereto.

37. The electronic blasting cap recited in claim 34 wherein said electronic module comprises:

means for full-wave rectifying an input signal to produce a DC signal, means for full-wave rectifying an input signal to produce a DC signal;

means connected to receive said DC signal and store an electrical charge;

means responsive to a transition of said input signal for producing a timing signal which has a continuously changing voltage;

means for detecting when said timing signal is equal to a reference voltage; and means for transferring at least a part of said electrical charge to said resistive element when said means for detecting detects that said timing signal is equal to said reference signal.

38. The circuit recited in claim 37 wherein said means for full-wave rectifying is a four diode bridge.

39. The circuit recited in claim 37 wherein said means connected to receive said DC signal is a capacitor coupled to the output terminals of said means for rectifying.

40. The circuit recited in claim 37 wherein said means for producing a timing signal is a series combination of a resistor and a capacitor.

41. The circuit recited in claim 37 wherein said means for detecting is a zener diode connected to monitor said timing signal.

42. The circuit recited in claim 37 wherein said means for transforming is a silicon controlled rectifier connected to said resistive element and activated by said means for detecting.

43. The electronic blasting cap recited in claim 34 wherein said electronic module comprises:

a full-wave rectifier having input terminals for receiving an input signal to produce therefrom a DC output signal which has a positive polarity at a first output terminal relative to a second output terminal;

a first resistor having the terminals thereof connected respectively to said first and second output terminals;

a first capacitor having a first terminal thereof connected to said first output terminal and a second terminal thereof connected to a first node;

a second resistor having a first terminal thereof connected to said first node and a second terminal thereof connected to said second output terminal;

a second capacitor having a first terminal thereof connected to said first node and a second terminal thereof connected to a second node;

a third resistor having a first terminal thereof connected to said second node and a second terminal thereof connected to said second output terminal;

a silicon controlled rectifier having anode, cathode and gate terminals, the cathode terminal thereof connected to said first node;

a zener diode having the anode terminal thereof connected to the gate terminal of said silicon controlled rectifier and the cathode terminal thereof connected to said second node; and a resistive firing element having a first terminal thereof connected to said first output terminal and a second terminal thereof connected to the anode terminal of said silicon controlled rectifier.

44. The circuit recited in claim 43 wherein said full-wave rectifier is a four diode bridge.

45. The electronic blasting cap recited in claim 34 wherein said electronic module comprises:

a full-wave rectifier having input terminals for receiving an input signal to produce therefrom a DC output signal which has a positive polarity at a first output terminal relative to a second output terminal;

a first capacitor having the terminals thereof connected respectively to said first and second output terminals;

a second capacitor having a first terminal thereof connected to said first output terminal and a second terminal thereof connected to a first node;

a first resistor having a first terminal thereof connected to said first node and a second terminal thereof connected to said second output terminal;

a silicon controlled rectifier having anode, cathode and gate terminals, the cathode terminal thereof connected to said first node;

a zener diode having the anode terminal thereof connected to the gate terminal of said silicon controlled rectifier and the cathode terminal thereof connected to said first output terminal; and a resistive firing element having a first terminal thereof connected to said first output terminal and a second terminal thereof connected to the anode terminal of said silicon controlled rectifier.

46. The circuit recited in claim 45 wherein said full-wave rectifier is a four diode bridge.

* * * * *

UNITED STATES PATENT AND TRADEMARK OFFICE

CERTIFICATE OF CORRECTION

PATENT NO. : 4,311,096

DATED : January 19, 1982

INVENTOR(S) : Gerald L. Oswald

It is certified that error appears in the above-identified patent and that said Letters Patent are hereby corrected as shown below:

Column 4, line 55, change "extended" to --extends--.

Column 6, line 19, change "of" to --on--.

Column 10, line 46, change "input" to --output--.

Signed and Sealed this

Twenty-second Day of June 1982

[SEAL]

Attest:

GERALD J. MOSSINGHOFF

Attesting Officer

Commissioner of Patents and Trademarks